United States Patent [19]

Kindberg

[11] 4,159,606

[45] Jul. 3, 1979

[54] BEAM AND METHOD OF MAKING IT

[76] Inventor: Bengt Å. Kindberg, Kadettvägen 29, 230 50 Bjärred, Sweden

[21] Appl. No.: 834,594

[22] Filed: Sep. 19, 1977

[30] Foreign Application Priority Data

Sep. 24, 1976 [SE] Sweden ..... 7610600

[51] Int. Cl.[2] ..... E04C 3/02

[52] U.S. Cl. ..... 52/692; 52/694; 52/741

[58] Field of Search ..... 52/692, 693, 694, 696, 52/642, 690, 741

[56] References Cited

U.S. PATENT DOCUMENTS

| | | | |
|---|---|---|---|
| 2,421,197 | 5/1947 | Green | 52/694 X |
| 3,019,491 | 2/1962 | Troutner | 52/694 X |
| 3,346,999 | 10/1967 | Johnson | 52/642 X |
| 3,813,842 | 6/1974 | Troutner | 52/642 X |

*Primary Examiner*—Price C. Faw, Jr.
*Assistant Examiner*—Carl D. Friedman
*Attorney, Agent, or Firm*—Beveridge, De Grandi, Kline & Lunsford

[57] ABSTRACT

A beam having flanges composed of wood pieces and a web consisting of a wire member bent alternately back and forth to extend between and being attached to the flanges at the bends. Each flange comprises at least two wood pieces which extend longitudinally of the beam and are joined together by gluing, at least one of the wood pieces having recesses in the surface joined with the other wood piece, which recesses are adapted to receive the bends of the wire member. The beam is manufactured in that recesses are arranged at regular intervals in a long wood piece, whereupon two such wood pieces provided with recesses are placed at a distance from one another corresponding to the distance between the flanges of the beam to be made, with the recesses in one wood piece exactly opposite to points situated halfway between the recesses in the other wood piece. Then the wire member bent alternately back and forth is placed with its bends alternately in the first and the second wood piece, whereupon an additional wood piece is glued on to the recessed side of each of the wood pieces.

10 Claims, 4 Drawing Figures

BEAM AND METHOD OF MAKING IT

The present invention relates to a beam having flanges composed of wood pieces and a web consisting of a wire member of metal bent to form a zigzag, meander or wave-like pattern having its bends attached to said flanges.

Beams with flanges of wood and a web of metal have been known for at least 25 years, but all the same they have never met with success. This is probably due to the fact that they have been too complicated in manufacture and, consequently, expensive, so that from an economic point of view they have been competitive with conventional beams in very large dimensions only.

The prior art will appear from West German Patent No. 810,188 dated Dec. 13, 1949, West German Patent No. 857,139 dated Feb. 23, 1950, West German Offenlegungsschrift No. 1,784,828 dated Sept. 24, 1968, and U.S. patent application Ser. No. 591,788, filed Nov. 3, 1966 by A. C. Sanford.

The object of the present invention is to provide a light beam of this type which has great torsional strength and can be manufactured also in small dimensions at a most competitive price.

This object is achieved in that each flange comprises at least two wood pieces which extend longitudinally of the beam and are joined by gluing, at least one of said wood pieces having recesses to receive the bends of the wire member in the surface joined with the other wood piece, said recesses having substantially the same form as the bends of the wire member.

The beam of the invention is especially suited for use in the construction of house walls which, as a result of the insignificant use of wood, will be much less expensive than conventional walls with wooden studs, and they will also be lighter in weight. The recesses for receiving the bends of the wire member may be exactly adjusted to these bends, or otherwise a longitudinally extending wire member may be attached to the bends and later be fitted in a groove cut for this purpose in the wood pieces. These two embodiments have proved particularly advantageous when the beam is subjected to heavy loads. By the term "wire member" there is to be understood in the following description and claims a wire member of either circular or rectangular cross-section.

The invention also relates to a method for manufacture of such beams. This method is characterized by arranging recesses at regular intervals in a long wood piece, placing two wood pieces, provided with such recesses, at a distance from one another corresponding to the distance between the flanges of the beam to be made, with the recesses in one wood piece being exactly opposite to points situated halfway between the recesses in the other wood piece, placing a wire member of metal, bent alternately back and forth, with a first bend in a recess in the first wood piece, placing the next bend in a recess in the second wood piece, the following bend in the first wood piece, etc., and gluing an additional wood piece on to the recessed side of each of the wood pieces.

Embodiments of the invention will be described in greater detail hereinbelow with reference to the accompanying drawing, in which.

Figure 1:
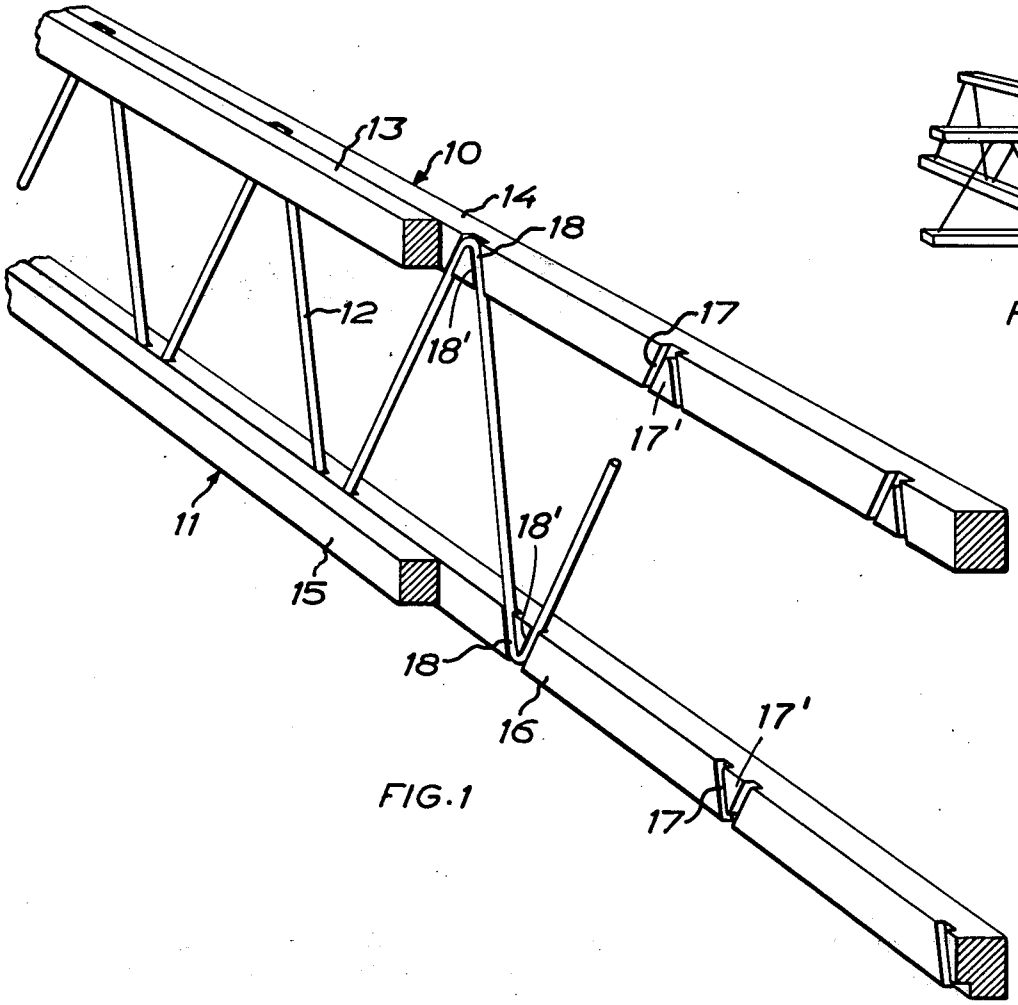
FIG. 1 is a perspective, partly sectional view of a beam made in accordance with the invention.

The beam of this invention comprises two flanges 10 and 11 which are interconnected by means of a beam web in the form of a wire 12 of metal, preferably iron, bent in zigzag. Either flange 10, 11 consists of two laths 13, 14 and 15, 16, respectively, which are joined by gluing. The glued surface extends, as appears from FIG. 1, in parallel with the plane of the web, i.e. the flange-forming laths 13, 14 and 15, 16, respectively, project in opposite directions from this plane. To strengthen the connection between the web-forming wire 12 and the laths 13–16, two of the laths 14 and 16 have recesses 17 arranged therein substantially of the same form as the bends 18 of the zigzag wire 12. The wood central portion 17' remains within each recess 17, corresponding to the open center 18' of each bend 18 of wire 12. The recesses 17 in the laths 14, 16 have a depth corresponding to the diameter of the wire 12. Of course, recesses 17 may be formed in both of the two interconnected laths 13, 14 and 15, 16, and in that case the recesses 17 have a depth corresponding to only half the diameter of the wire 12. However, for manufacturing reasons the embodiment illustrated in FIG. 1 is to be preferred. The recesses may extend wholly or partly over the height of the laths.

In the manufacture of the beam, the laths 14, 16 are first provided with recesses 17 at predetermined intervals. Then the laths 14, 16 are placed at a distance from each other corresponding to the distance between the flanges of the beam to be made, and one lath is displaced relative to the other so that the recesses 17 therein will be opposite to points situated halfway between the recesses 17 in the other lath. After that the surface of the laths 14, 16 provided with the recesses 17 are coated with glue and the web-forming wire 12 is pressed in position with bends 18 in the recesses. The laths 13 and 15 are then placed on the glue-coated surfaces and after hardening of the glue the beam is ready for use.

Figure 2:
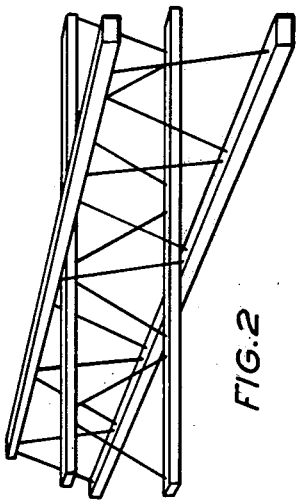
FIG. 2 shows how two beams according to the invention cross each other.

The beam according to FIG. 1 may be manufactured in various dimensions which preferably are adjusted to each other so that one beam can cross another, as illustrated in FIG. 2, resulting in intersections where nailing may be effected in a simple way.

The beam of the invention is of course produced preferably continuously in a machine suitable for the purpose. A special advantage resides in the fact that refuse wood of lengths in stock can be used for making the laths 13–16 by end-jointing the laths in a conventional manner and then feeding them into said machine.

Obviously the beam of the invention may be modified within wide limits with respect to the form of the flanges and the web. Thus the flanges 10, 11 may comprise several wood pieces and be shaped otherwise than shown in the drawings, while the web 12 can be formed of a wire or band which, as an alternative to the zigzag form shown, may be bent in a meander or wave-like pattern or some other appropriate form.

Figure 3:
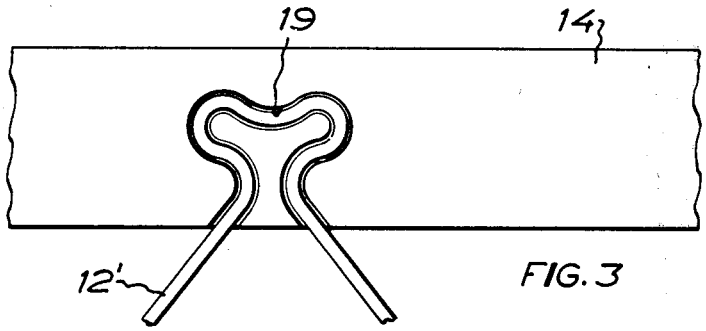
FIGS. 3 and 4 show vertical projections of modified beam flange embodiments.
Figure 4:
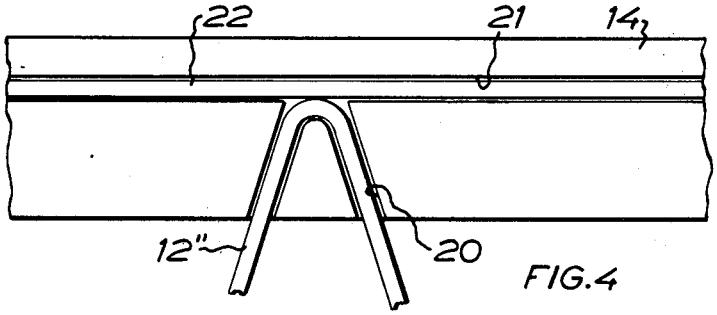

According to FIG. 1 the recesses 17 consist of two straight parts which are inclined in relation to each other and converge at the side of the flange facing away from the web, but if the beam is intended for heavy loads it has been found advantageous to form the bends of the web wire 12' in a special fashion, for instance by providing a contour, as indicated in FIG. 3 which also shows a modified recess 19 in the flange lath 14 in which the bend is to be situated. Another possibility of increasing the flexural strength of the beam is indicated in FIG. 4, where the flange lath 14 comprises, in addition to a recess 20 corresponding to the recess 17, a longitudinally extending recess 21 into which the recess 20 opens. In these recesses it is possible to place a web wire 12'' and a longitudinally extending wire 22 which is joined with the upper ends of the bends, e.g. by welding.

The beam shown is primarily intended for manufacturing building constructions, for instance as a stud or a horizontal beam. In the manufacture of for instance a wall construction the beams are placed such that the outer sides of their flanges come to lie in relatively parallel planes, whereupon panels are nailed to the outer sides of the flanges. It may of course also be used for many other purposes in the building trade, e.g. for the manufacture of roof trusses, as well as in other fields.

What I claim and desire to secure by Letters Patent is:

1. An elongated beam comprising a metal wire web member bent alternately back and forth to lie in a plane with a plurality of bent portions defining a pair of lines;

a first wood lath member having in a first surface thereof a first plurality of recesses shaped substantially to conform to the bent portions of one of said pair of lines of said wire web member while leaving within said first plurality of recesses the wood conforming to the open centers of said bent portions of said one of said pair of lines, the bent portions of said one of said pair of lines being positioned in said first plurality of recesses;

a second wood lath member having in a first surface thereof a second plurality of recesses shaped substantially to conform to the bent portions of the other of said pair of lines of said wire web member while leaving within said second plurality of recesses the wood conforming to the open centers of said bent portions of said other of said pair of lines, the bent portions of said other of said pair of lines being positioned in said second plurality of recesses;

a third wood lath member substantially coextensive with said first wood lath member and glued to said first surface of said first wood lath member to cover the recesses thereof and to retain therein said bent portions of said one of said pair of lines; and a fourth wood lath member substantially coextensive with said second wood lath member and glued to said first surface of said second wood lath member to cover the recesses thereof and to retain therein said bent portions of said other of said pair of lines.

2. A beam as claimed in claim 1, wherein said wire web member is bent to form a zigzag pattern.

3. A beam as claimed in claim 1, wherein said wire web member is bent to form a meander pattern.

4. A beam as claimed in claim 1, wherein said wire web member is bent to form a wave-like pattern.

5. A beam as claimed in claim 1, wherein said wire web member is bent to form a wave-like pattern with corrugated wave crests.

6. A beam as claimed in claim 1 in which said metal wire web member is devoid of laterally protruding parts.

7. A beam as claimed in claim 1 in which the at least one lath of each pair has an elongated recess extending longitudinally in the glued surface thereof and communicating with the plurality of recesses therein; said beam further comprising a further wire member positioned in said elongated recess and joined with the bent portions of said bent metal wire web member.

8. A method of making an elongated beam comprising:

bending a wire alternately back and forth to form a substantially planar metal wire web member having a plurality of bent portions defining a pair of lines;

forming in a first surface of a first wood lath member a first plurality of recesses shaped substantially to conform to the bent portions of one of said pair of lines of said wire web member while leaving within said first plurality of recesses the wood conforming to the open centers of said bent portions of said one of said pair of lines;

forming in a first surface of a second wood lath member a second plurality of recesses shaped substantially to conform to the bent portions of the other of said pair of lines of said wire web member while leaving within said second plurality of recesses the wood conforming to the open centers of said bent portions of said other of said pair of lines;

positioning the bent portions of said one of said pair of lines in said first plurality of recesses;

positioning the bent portions of said other of said pair of lines in said second plurality of recesses;

gluing a third wood lath member to said first surface of said first wood lath member to cover said first plurality of recesses to retain therein said bent portions of said one of said pair of lines; and gluing a fourth wood lath member to said first surface of said second wood lath member to cover said second plurality of recesses to retain therein said bent portions of said other of said pair of lines.

9. A method as claimed in claim 8 further comprising forming a longitudinally extending recess in said first surface of each of said first and second wood lath members simultaneously with the forming of the other recesses therein, and placing in said longitudinally extending recess a further wire member connected with the bent portions of said metal wire web member when the bent portions are placed in their recesses.

10. A building construction comprising:

(a) a plurality of elongated beams, each beam including:

(i) a metal wire web member bent alternately back and forth to lie in a plane with a plurality of bent portions defining a pair of lines;

(ii) a first wood lath member having in a first surface thereof a first plurality of recesses shaped substantially to conform to the bent portions of one of said pair of lines of said wire web member while leaving within said first plurality of recesses the wood conforming to the open centers of said bent portions of said one of said pair of lines, the bent portions of said one of said pair of lines being positioned in said first plurality of recesses;

(iii) a second wood lath member having in a first surface thereof a second plurality of recesses shaped substantially to conform to the bent portions of the other of said pair of lines of said wire web member while leaving within said second plurality of recesses the wood conforming to the open centers of said bent portions of said other of said pair of lines, the bent portions of said other of said pair of lines being positioned in said second plurality of recesses;

(iv) a third wood lath member substantially coextensive with said first wood lath member and glued to said first surface of said first wood lath member to cover the recesses thereof and to retain therein said bent portions of said one of said pair of lines, to thereby form a first flange member; and (v) a fourth wood lath member substantially coextensive with said second wood lath member and glued to said first surface of said second wood lath member to cover the recesses thereof and to retain therein said bent portions of said other of said pair of lines, to thereby form a second flange member, said beams being placed with the outer sides of one of the flanges of each beam defining a surface; and (b) a plurality of panels nailed to said outer sides of one of the flanges of each beam.

* * * * *